US006484874B1

(12) United States Patent
Kageyama et al.

(10) Patent No.: US 6,484,874 B1
(45) Date of Patent: Nov. 26, 2002

(54) MEDICAL CONTAINER WITH MULTIPLE CHAMBERS AND METHOD OF PRODUCING THE SAME

(75) Inventors: Yohei Kageyama, Kanagawa (JP); Akihiko Sakata, Kanagawa (JP); Manabu Nakamura, Kanagawa (JP); Junji Yotsuyanagi, Kanagawa (JP)

(73) Assignee: Showa Denko Plastic Products Co., Ltd., Tokyo (JP)

( * ) Notice: Subject to any disclaimer, the term of this patent is extended or adjusted under 35 U.S.C. 154(b) by 0 days.

(21) Appl. No.: 09/624,080

(22) Filed: Jul. 24, 2000

Related U.S. Application Data

(60) Provisional application No. 60/152,955, filed on Sep. 9, 1999.

(30) Foreign Application Priority Data

Jul. 22, 1999 (JP) ..... 11-208290
May 16, 2000 (JP) ..... P 2000-143970

(51) Int. Cl.[7] ..... B65D 25/08

(52) U.S. Cl. ..... 206/219; 206/221; 604/410; 604/416

(58) Field of Search ..... 206/219, 220, 206/221, 222, 568, 524.8; 604/410, 416

(56) References Cited

U.S. PATENT DOCUMENTS 3,082,867 A * 3/1963 Gelpey ..... 206/219
5,121,302 A * 6/1992 Bay et al. ..... 362/34
5,267,646 A 12/1993 Inoue et al.
5,370,221 A * 12/1994 Magnusson et al. ..... 206/221
5,501,887 A * 3/1996 Tanaka et al. ..... 428/35.2

FOREIGN PATENT DOCUMENTS

JP 6-197938 7/1994

* cited by examiner

*Primary Examiner*—Mickey Yu
*Assistant Examiner*—Jila M. Mohandesi
(74) *Attorney, Agent, or Firm*—Sughrue Mion, PLLC

(57) ABSTRACT

One object of the present invention is to provide a medical container with multiple chambers and a production method thereof, where respective medicaments housed in a plurality of chambers can be separated without fail until performing the infusion and when performing the infusion, the respective medicaments can be easily mixed while keeping the sterile state. In order to achieve this object, a medical container (1) with multiple chambers is provided, where a container (10) having a chamber (11) for housing a liquid medicament (12) and a container (20) having a chamber (21) for housing a solid medicament (22) are integrated, a partitioning member (30) for partitioning these containers (10, 20) is provided, a hollow part (31) for connecting two adjacent containers (10, 20) to allow communication therebetween and a lid (32) for sealing at least one end of the hollow part (31) are formed in the partitioning member (30), and a thin-wall part (34) is formed in the connection part between the lid (32) and the partitioning member body (33).

17 Claims, 7 Drawing Sheets

MEDICAL CONTAINER WITH MULTIPLE CHAMBERS AND METHOD OF PRODUCING THE SAME

CROSS REFERENCE TO RELATED APPLICATIONS

This application is an application filed under 35 U.S.C. §111(a) claiming benefit pursuant to 35 U.S.C. §119(e) (1) of the filing date of Provisional Application No. 60/152,955 filed Sep. 9, 1999 pursuant to 35 U.S.C. §111(b).

BACKGROUND OF THE INVENTION

1. Field of the Invention

The present invention relates to a medical container, particularly a medical container for use in instillation. More specifically, the present invention relates to a medical container with multiple chambers, where a plurality of medicaments are housed in multiple chambers, and the respective medicaments are prevented from leaking or mixing until the infusion, and the respective medicaments can be easily mixed at the time of infusion.

2. Description of Related Art

In the case of preparing an infusion medicament by mixing a plurality of medicaments immediately before the administration of the infusion medicament, it is necessary to prevent foreign bodies or miscellaneous bacteria from mixing into the infusion medicament.

An example of a medical container capable of mixing a plurality of medicaments in a sterile environment is a medical container with multiple chambers, where the inner wall surface of a bag container formed of a synthetic resin-made film is heat-sealed and a plurality of medicaments are housed in multiple chambers partitioned by sealed parts within the bag container. According to this medical container with multiple chambers, the sealed part partitioning respective chambers is peeled open to unite the chambers within the container into one chamber, whereby the respective medicaments can be mixed.

In such a medical container with multiple chambers, the medicaments must be separated from each other without fail until the infusion. Therefore, it is required that the sealed part in the medical container with multiple chambers not be readily peeled open as a result of ordinary handling before the infusion, for example, during washing, partial filling or sterilization of the medical container with multiple chambers. On the other hand, it is necessary that, when the sealed part is peeled open, it opens by itself, without damaging the container body.

Examples of medical containers with multiple chambers, of which the fused part satisfies such requirements, have been proposed in Japanese Unexamined Patent Application, First Publication Nos. Sho 63-19149, Hei 1-240469, Hei 2-4671, Hei 6-39018 and Hei 8-24314. The fused part proposed in these patent publications includes a type where the inner surface of a bag container formed of a mixture of two or more kinds of synthetic resins having poor compatibility is thermally bonded to form an easily peelable part, a type where a separate film as a layer having the welding and peeling function is laminated on the inner surface of a container, and a type where the heating and pressurizing conditions from the outer surface are strictly controlled to form a weak seal part.

However, if the adhesion strength in the fused part of these types of fused part is controlled to fall within the range of the desired low adhesion strength, the latitude in selecting the sealing conditions for the fused part becomes very narrow. Accordingly, if the sealing conditions depart from the predetermined range and the adhesion strength attained is less than the desired low adhesion strength, the fused part is likely to show partial peeling as the result of handling before the infusion, for example, during washing, partial filling or sterilization, whereas if the adhesion strength exceeds the objective low adhesion strength, the fused part may not be peeled open when mixing the respective medicaments.

In order to solve these problems, Japanese Unexamined Patent Application, First Publication Nos. Hei 4-364851 and Hei 7-155361 have proposed a medical container with multiple chambers, where a pipe or hollow plug closed at one end is provided in the partition part of each chamber. In this type of medical container with multiple chambers, respective chambers may be communicated to mix the medical solutions by breaking off the pipe or hollow plug in the partition part.

However, the pipe or hollow plug provided in the partition part may be damaged due to folding or the like of the container before the infusion. Furthermore, for forming a pipe or hollow plug which can be easily broken off, the pipe or hollow plug itself must have a small diameter but this requirement is accompanied with a limitation in the flow of a medicament passing through the pipe or hollow plug and a problem arises in that the operation of mixing the medicaments takes time.

SUMMARY OF THE INVENTION

One object of the present invention is, accordingly, to provide a medical container with multiple chambers, in which respective medicaments housed in a plurality of chambers can be separated without fail until the infusion and at the time of infusion, these medicaments can be easily mixed while keeping the sterile state. Another object of the present invention is to provide a production method of the medical container with multiple chambers.

More specifically, the medical container with multiple chambers of the present invention is obtained by integrating a plurality of containers each having a chamber for housing a medicament, wherein the medical container has a partitioning member for partitioning the plurality of containers; in the partitioning member, a hollow part for connecting two adjacent containers to allow communication therebetween and a lid for sealing at least one end of the hollow part are formed; and in the connection part between the lid and the partitioning member body, a thin-wall part is formed.

In a preferred embodiment, at least one of the plurality of containers has a chamber for housing a powder medicament, another container has a chamber for housing a liquid medicament, and a heat-seal part is provided between the partitioning member and the chamber for housing a powder medicament, which can be peeled open by the inflow pressure of the liquid medicament.

In another preferred embodiment, the partitioning member is elongated in the width direction of the container and narrow in the thickness direction of the container and both end parts of the partitioning member in the width direction of the container are shaped like the prow of a boat.

In another preferred embodiment, the lid has a ribbon shape and ribs running in the cross direction of the lid are provided on the lid surface in the hollow part side.

In another preferred embodiment, an inclined surface is formed on each lateral surface of the lid to incline from the lateral side to the inner side along the direction toward the hollow part side.

In another preferred embodiment, the partitioning member may have cross sections of any of rhombic, elongated ellipse, and circular shape.

The medical container with multiple chambers of the present invention may also have a construction such that the partitioning member comprises a sealing member having formed therein a hollow part and a lid for sealing one end of the hollow part, and a communicating member in the hollow form joined to the end face of the sealing member in the opening side; the sealing member is provided at the end part of a first container having a chamber for housing a liquid medicament; and the communicating member is provided at the end part of a second container having a chamber for housing a powder medicament.

The method for producing a medical container with multiple chambers containing medicaments according to the present invention comprises inserting a support, from the opening of a partitioning member having formed therein a hollow part and a lid for sealing one end of the hollow part, into the hollow part so as to maintain the shape of the hollow part; inserting the partitioning member into the opening end of a first bag container having a chamber for housing a liquid medicament and a filling port for filling a liquid medicament from the outside of the container into the chamber and being open at the end part opposite the end part having the filling port, so that the opening side of the partitioning member faces the outside of the first container, followed by welding of the first container and the partitioning member; inserting the other end of the partitioning member into the opening end of a second bag container having a chamber for housing a powder medicament and being opened at one end, followed by welding of the second container and the partitioning member; heat-sealing the space between the chamber in the second container and the partitioning member to form a heat-seal part which is peelable by the inflow pressure of a liquid medicament; filling a liquid medicament into the chamber of the first container from the filling port of the first container; sealing the filling port of the first container, followed by high-pressure steam sterilization; opening the end part of a second container opposite the end part welded to the partitioning member, followed by filling of a powder medicament into the chamber of the second container in a sterile room; and sealing the opening end of the second container filled with the powder medicament.

In another embodiment, the method for producing a medical container with multiple chambers containing medicaments of the present invention comprises inserting a support, from the opening of a sealing member having formed therein a hollow part and a lid for sealing one end of the hollow part, into the hollow part so as to maintain the shape of the hollow part; inserting the sealing member into the opening end of a first bag container having a chamber for housing a liquid medicament and a filling port for filling a liquid medicament from the outside of the container into the chamber and being open at the end part opposite the end part having the filling port, so that the opening side of the sealing member faces the outside of the first container, followed by welding of the first container and the sealing member; removing the support inserted into the hollow part of the sealing member; filling a liquid medicament into the chamber of the first container from the filling port of the first container; sealing the filling port of the first container, followed by high-pressure steam sterilization; inserting a support, from the opening of a communicating member having formed therein a hollow part, into the hollow part so as to maintain the shape of the hollow part; inserting the communicating member into the opening end of a second bag container having a chamber for housing a powder medicament and being open at one end part, so that the hollow part of the communicating member allows communication between the interior and the exterior of the chamber of the second container, followed by welding of the second container and the communicating member; removing the support inserted into the hollow part of the communicating member; heat sealing across the width of the second container in the space between the chamber in the second container and the communicating member to form a heat seal part which is peelable by the inflow pressure of a liquid medicament; opening the end part of the second container opposite the end part welded to the communicating member, followed by filling of a powder medicament into the chamber of the second container in a sterile room; sealing the opening end of the second container filled with the powder medicament; and welding the end face of the sealing member of the first container to the end face of the communicating member of the second container, thereby integrating the first container and the second container.

The medical container with multiple chambers of the present invention is obtained by integrating a plurality of containers each having a chamber for housing a medicament and has a partitioning member for partitioning these containers. In the partitioning member, a hollow part connecting two adjacent containers to allow communication therebetween and a lid for sealing at least one end of the hollow part are formed. In the connection part between the lid and the partitioning member body, a thin-wall part is formed. Therefore, respective medicaments housed in a plurality of chambers can be separated without fail until performing the infusion, and at the time of infusion, the respective medicaments can be easily mixed while keeping the sterile state.

In the case where at least one of the plurality of containers has a chamber for housing a powder medicament, another container has a chamber for housing a liquid medicament and a heat-seal part peelable by the inflow pressure of the liquid medicament is provided between the partitioning member and the chamber for housing the powder medicament, the chamber for housing the powder medicament can be improved in its isolation property and the powder medicament housed in the chamber can be insulated from the atmosphere outside the container.

In the case where ribs running in the cross direction of the lid are provided on the hollow part side of the lid, the lid can easily open by a deformation operation applied to the partitioning member and the lid can be prevented from rising to close at the time of mixing of medicaments.

In the case where inclined surfaces inclining from the lateral side to the inner side along the direction toward the hollow part side are formed on the lateral surfaces of the lid, the lid can be prevented from swinging open towards the hollow part side by the deformation operation applied to the partitioning member.

In the case where the partitioning member is elongated in the width direction of the container and narrow in the thickness direction of the container, and each end part of the partitioning member in the width direction of the container is shaped like the prow of a boat, the two sheets of synthetic resin-made films constituting the container can be welded to the partitioning member without generating any gaps.

Furthermore, according to the production method of a container with multiple chambers of the present invention, the container and the partitioning member can be welded without generating any gaps, so that in the medical container with multiple chambers obtained, the respective medicaments housed in a plurality of chambers can be separated without fail until performing the infusion.

In particular, according to the medical container with multiple chambers and the production method thereof, where the partitioning member comprises a sealing member having formed therein a hollow part and a lid for sealing one end of the hollow part and a hollow communicating member joined to the opening side end face of the sealing member, the sealing member being provided at the end part of the first container having a chamber for housing a liquid medicament and the communicating member being provided at the end part of the second container having a chamber for housing a powder medicament, the first container and the second container can be prepared in separate places and medicaments can be filled into respective containers in separate places.

DESCRIPTION OF THE PREFERRED EMBODIMENTS

Figure 1:
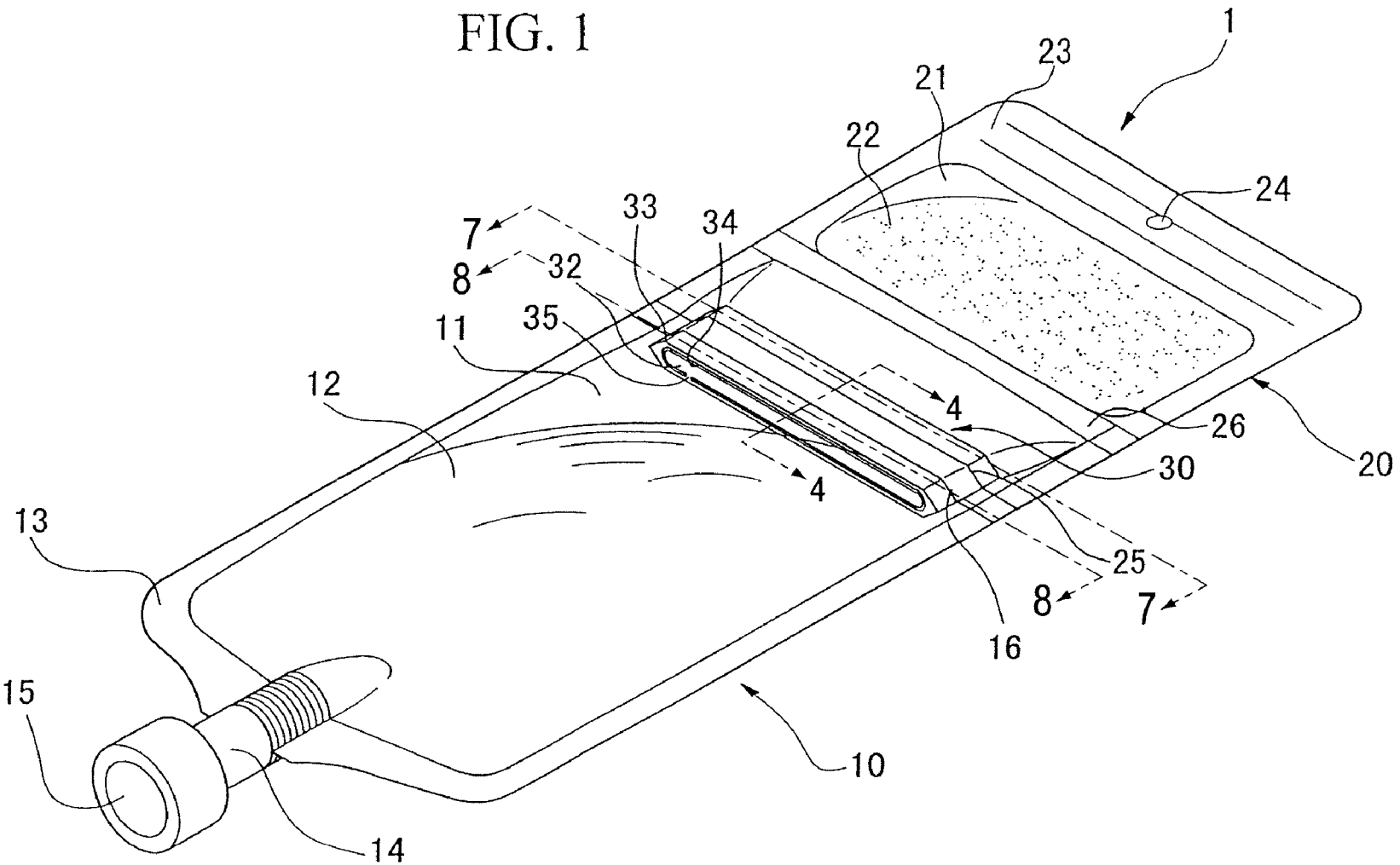
FIG. 1 is perspective view showing one example of the medical container with multiple chambers according to the present invention.

The present invention is described in detail below by referring to the drawings attached hereto.

Embodiment 1

FIG. 1 is a perspective view showing one embodiment of the medical container with multiple chambers of the present invention.

The medical container 1 with multiple chambers is a container constructed, roughly, such that a first container 10 having formed in the inside thereof a chamber 11 for housing a liquid medicament 12 and a second container 20 having formed in the inside thereof a chamber 21 for housing a powder medicament 22 are integrated and a partitioning member 30 for partitioning the first container 10 and the second container 20 is provided.

The first container 10 is a bag container formed by welding heat-seal parts 13 at the peripheral edges of two sheets of synthetic resin-made films. At the lower end of the first container 10, a hollow plug 14 for filling a liquid medicament 12 into the chamber 11 or discharging the liquid medicament 12 out of the first container 10 is welded by heat-sealing. The hollow plug 14 is sealed by a rubber cap 15. The upper end of the first container 10 is sealed by the partitioning member 30 welded to a heat-seal part 16.

The first container 10 is constructed of a material having flexibility, transparency for confirmation of contents, and resistance to the heat of high-pressure steam sterilization. Examples of the material for the first container 10 include thermoplastic resins such as polyolefin resins such as polyethylene and polypropylene, polyesters such as polyethylene terephthalate and polybutylene terephthalate, and polyvinylidene chloride.

In FIG. 1, the bag constituting the first container 10 is obtained by heat-sealing the peripheral edges of two sheets of film obtained by T-die molding or lamination molding, however, the present invention is by no means limited thereto and a cylindrical film obtained by inflation molding may also be used. The film used for the first container 10 may also be a stacked layer film.

The second container 20 is a bag container formed by welding heat-seal parts 23 of two sheets of synthetic resin-made film. In the center of the heat-seal part 23 of the second container 20, a hole 24 for hanging is punched. The heat-seal part 25 at the lower end of the second container is welded to the heat-seal part 16 and between the chamber 21 within the second container 20 and the partitioning member 30, a weak seal part 26 is formed by heat-sealing along the cross direction of the second container 20.

The second container 20 is constructed of a material having flexibility and also having impermeability to oxygen and water vapor so as to inhibit the deterioration of powder medicament 22. More specifically, a stacked layer film having a barrier layer as the outermost layer is preferred. Examples of the material for the barrier layer include ethylene-vinyl alcohol copolymers, polyamide, polyvinyl chloride, polyvinylidene chloride, polyethylene, polypropylene, polyester, aluminum foil, silicon oxide-deposited resin film, aluminum oxide-deposited resin film, and aluminum-deposited resin film. For forming the barrier layer, one of these materials may be used alone or two or more thereof may be stacked. The stacked layer film for forming the second container 20 may be obtained by general multi-layer inflation molding, multilayer T-die molding or lamination molding using the materials for the barrier layer and if desired, the above-descried thermoplastic resin. The bag constituting the second container 20 is obtained by heat-sealing the peripheral edges of two sheets of stacked films.

The weak seal part 26 is provided so as to insulate the powder medicament 22 housed in the chamber 21 from the atmosphere outside the second container 20. The weak seal part 26 has a fusion strength such that the weak seal part 26 can be peeled open by the inflow pressure of a liquid medicament running out from the first container 10. More specifically, the fusion strength is preferably such that the peel-opening starts when a pressure of from 0.002 to 0.015 MPa is applied from the exterior.

Figure 2:
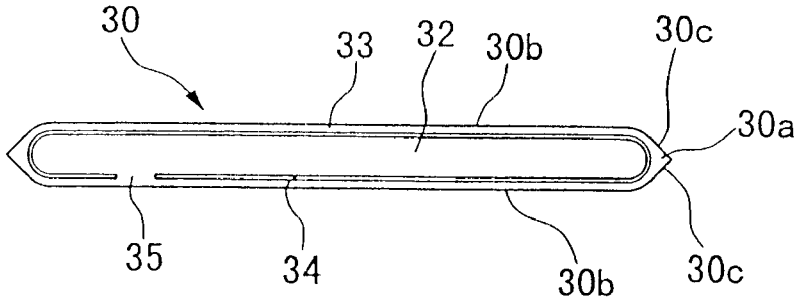
FIG. 2 is a bottom view showing one example of the partitioning member in the medical container with multiple chambers according to the present invention.
Figure 3:
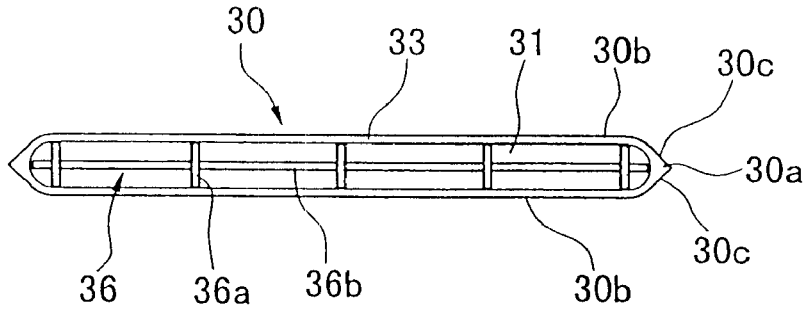
FIG. 3 is a top view showing one example of the partitioning member in the medical container with multiple chambers according to the present invention.
Figure 4:
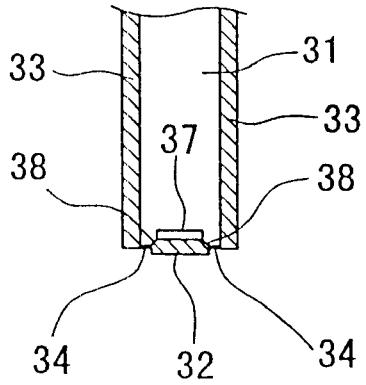
FIG. 4 is a cross-sectional view showing the vicinity of the bottom surface in one example of the partitioning member in the medical container with multiple chambers according to the present invention.

FIG. 2 and FIG. 3 are a bottom view and a top view, respectively, of the partitioning member 30, and FIG. 4 is a cross-sectional view showing the vicinity of the bottom surface of the partitioning member 30.

The partitioning member 30 is a hollow body which is elongated in the width direction of the first container 10 and the second container 20, and narrow in the thickness direction of the containers. In this partitioning member 30, in between the top surface and the bottom surface, a hollow part 31, and a ribbon shaped lid 32 for sealing the bottom surface side of the hollow part 31 are formed. In the connecting part between the lid 32 and the partitioning member body 33, a thin-wall part 34 and a thick-wall part 35 are formed. Into the hollow part 31 of the partitioning member 30, a support 36 is inserted.

Each end part 30*a* in the width direction of the partitioning member 30 is shaped like the prow of a boat or a wedge, defined by two inclined surfaces 30*c* formed to incline from two respective surfaces 30*b* of the partitioning member 30. On the lid 32 surface in the hollow part 31 side, a plurality of ribs 37 running in the cross direction of the lid 32 are provided and on each lateral surface of the lid, an inclined surface 38 is formed to incline from the lateral side of the lid 32 to the inner side along the direction toward the hollow part 31 side.

Examples of the material for the partitioning member 30 include polyolefin resins such as polyethylene and polypropylene, styrene-type resins such as ABS resin, AS resin and MBS resin, polyvinyl chloride, polyester, polystyrene and polycarbonate.

The thin-wall part 34 formed in the connecting part between the lid 32 and the partitioning member body 33 can be ruptured by a deformation operation applied from the exterior to the partitioning member 30. The thick-wall part 35 is not ruptured by the deformation operation from the exterior and continues to connect the lid 32 and the partitioning member body 33. The thin-wall part 34 preferably has a thickness of from 0.1 to 0.2 mm. If the thickness of the thin-wall part 34 is less than 0.1 mm, the thin-wall part 34 may be ruptured by the weight of the medicament 12 itself or by the internal pressure during the retort sterilization of the first container 10, whereas if it exceeds 0.2 mm, an unnecessarily high pressure is disadvantageously required during the deformation operation applied to the partitioning member 30.

The support 36 comprises a plurality of ribs 36*a* running across the width of the hollow part 31 and a connecting member 36*b* extending in the longitudinal direction of the hollow part 31 to connect the center parts of the ribs 36*a*, so that at the time of heat-sealing both surfaces 30*b* of the partitioning member 30 with the upper end of the first container 10 and heat-sealing both surfaces of the partitioning member 30 with the lower end of the second container 20, the shape of the hollow part 31 can be maintained, both surfaces 30*b* of the partitioning member can be prevented from distorting due to the heat-sealing pressure, and the heat-seal surface can be free of mottling or gapping.

Figure 5:
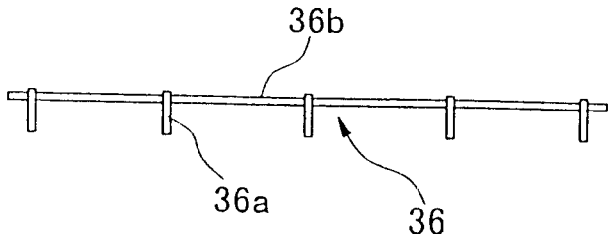
FIG. 5 is a top view showing another example of the support inserted into the hollow part of the partitioning member.
Figure 6:
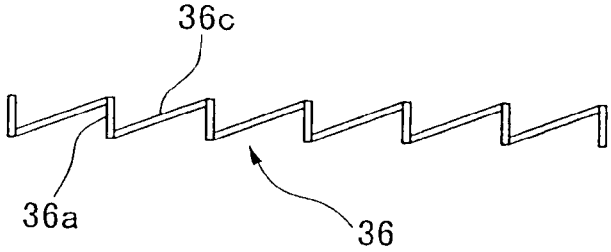
FIG. 6 is a top view showing another example of the support inserted into the hollow part of the partitioning member.

The support 36 is not limited to the example shown in the figure and any support may be used if it has a plurality of ribs 36*a* running across the width of the hollow part 31 and at the same time can be bent in the cross direction of the hollow part 31. For example, as shown in FIG. 5, a support having a plurality of ribs 36*a* running across the width of the hollow part 31 and a connecting member 36*b* extending along the length of the hollow part 31 to connect the upper end parts of the ribs 36*a*, or as shown in FIG. 6, a support having a plurality of ribs 36*a* running across the width of the hollow part 31 and connecting members 36*c* for connecting the lower end part of a rib 36*a* and the upper end part of an adjacent rib 36*a*, may be used.

Figure 7:
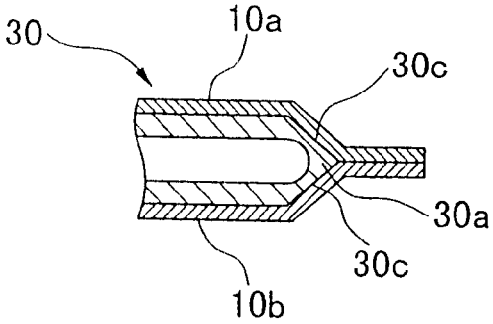
FIG. 7 is a cross-sectional view showing the vicinity of the short side in one example of the partitioning member in the medical container with multiple chambers according to the present invention.
Figure 8:
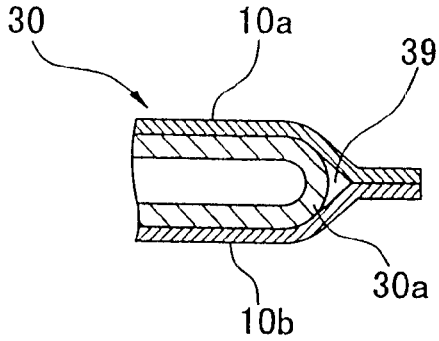
FIG. 8 is a cross-sectional view showing the vicinity of the short side in another example of the partitioning member.

The inclined surfaces 30*c* are formed at each end part 30*a* in the width direction of the partitioning member 30, so that during the heat-sealing, for example, of the partitioning member 30 and the upper end of the first container 10, two sheets of synthetic resin-made films 10*a* and 10*b* constituting the first container 10 can be welded to the partitioning member 30 without any gaps, as shown in FIG. 7. If the end part 30*a* in the width direction of the partitioning member 30 forms a curved face, a pinhole 39 may occur between the lateral side of the partitioning member 30 and the two sheets of synthetic resin-made films 10*a* and 10*b*.

The ribs 37 are provided so as to increase the strength of the lid 32 in the direction of its width, and increase the difference between the stress applied to the lid 32 and the stress applied to the partitioning member body 33 resulting from the external force applied by the deformation operation, and thereby accelerate the opening of the lid 32. After the swinging open the lid 32, the ribs 37 contact the edge face of the partitioning member body 33 to act as stoppers and thereby the lid 32 can be prevented from swinging closed when mixing the medicament 12 and the medicament 22.

The inclined surface 38 formed on the lateral surfaces of the lid 32 prevent the lid 32 from swinging open towards the hollow part 31 side but allow the lid 32 to swing open toward the outer side of the partitioning member 30 when a deformation is operation applied to the partitioning member 30.

Figure 9:
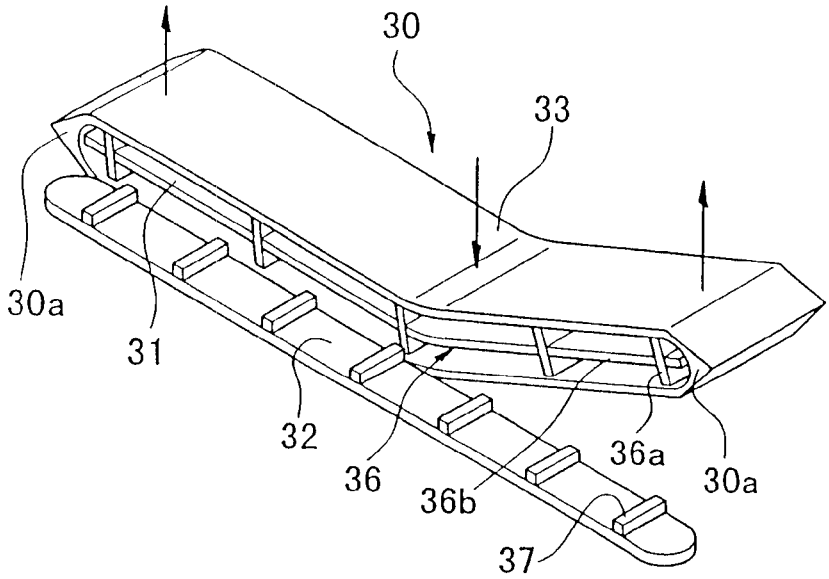
FIG. 9 is a perspective view showing one example of the opened state of the partitioning member in the medical container with multiple chambers according to the present invention.

When the partitioning member 30 is bent into a V-shape, as shown in FIG. 9, by applying a force to the width direction end parts 30*a* at both sides of the partitioning member 30 in the thickness direction of the container, and at the same time, applying a force to the width direction center part of the partitioning member 30 in the opposite direction different to that applied to the width direction end parts 30*a*, stresses are applied to the lid 32 and the partitioning member body 33 resulting from the external forces, and this difference in the stresses causes rupturing of the thin-wall part 34 formed in the connecting part between the lid 32 and the partitioning member body 33, whereby the lid 32 swings open toward the outside of the partitioning member 30. In this way, the first container 10 and the second container 20 are allowed to communicate and thereby the medicament 12 and the medicament 22 can be mixed. At this time, the lid 32 is connected to the partitioning member body 33 by the thick-wall part 35 and does not come off.

Figure 10:
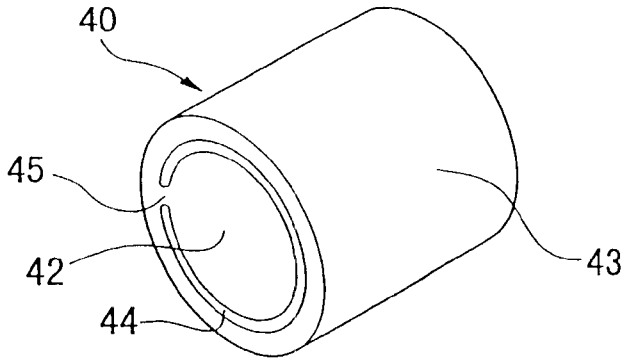
FIG. 10 is a perspective view showing another example of the partitioning member in the medical container with multiple chambers according to the present invention.

The partitioning member in the medical container with multiple chambers of the present invention is not limited to the above-described member as long as a hollow part and a lid for sealing at least one end of the hollow part are formed and a thin-wall part is formed in the connecting part between the lid and the partitioning member body. Other examples of the partitioning member include, as shown in FIG. 10, a cylindrical partitioning member 40 where a hollow part and a circular lid 42 for sealing the bottom side of the hollow part are formed and a thin-wall part 44 and a thick-wall part 45 are formed in the connecting part between the lid 42 and the partitioning member body 43.

Figure 11:
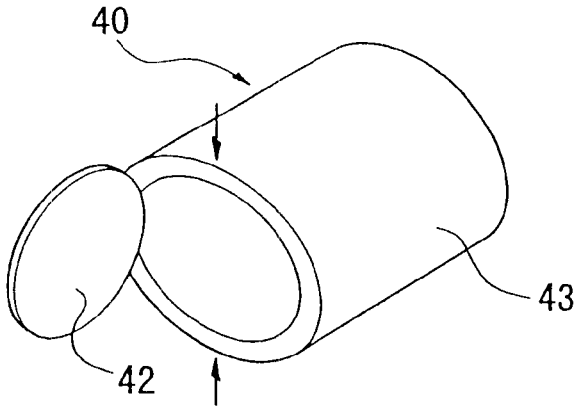
FIG. 11 is a perspective view showing another example of the opened state of the partitioning member in the medical container with multiple chambers according to the present invention.

In this partitioning member 40, as shown in FIG. 11, when the circumferential wall of the partitioning member 40 is pressed, different stresses are generated in the lid 42 and the partitioning member body 43 resulting from the external force and this difference in the stresses causes rupturing of the thin-wall part 44 formed in the connecting part between the lid 42 and the partitioning member body 43 and allows the lid 42 to be pushed open toward the outer side of the partitioning member 40.

Figure 12:
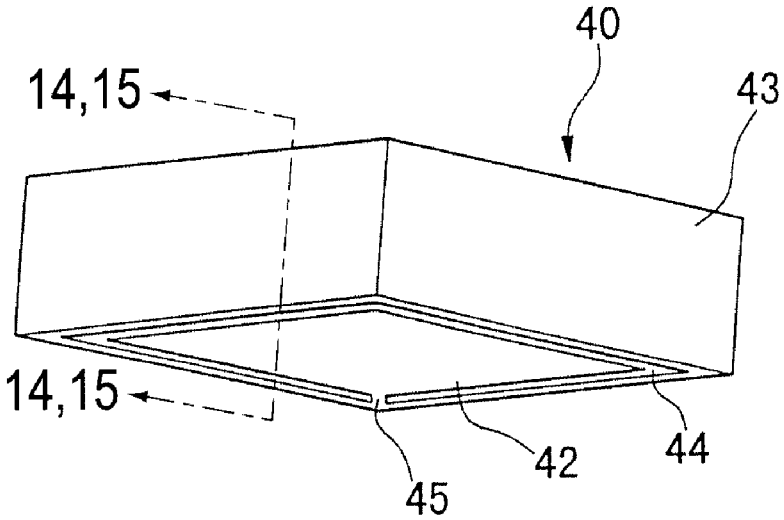
FIG. 12 is a perspective view of another example of the partitioning member in the medical container with multiple chambers according to the present invention.
Figure 13:
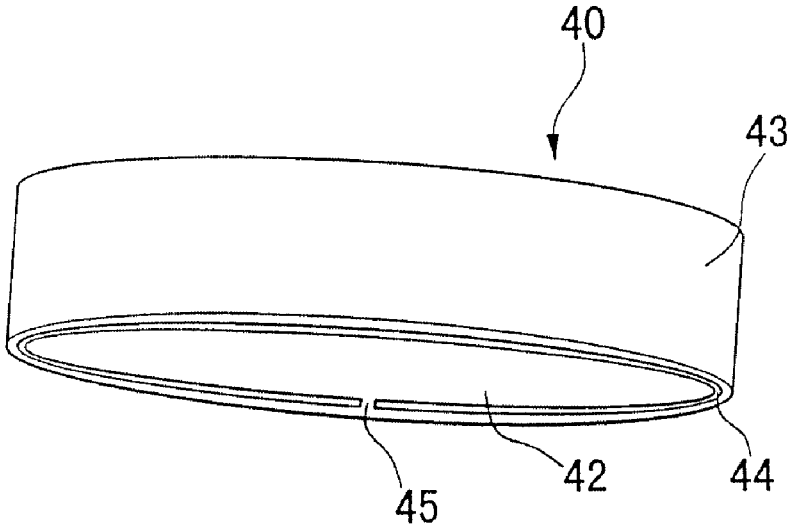
FIG. 13 is a perspective view of another example of the partitioning member in the medical container with multiple chambers according to the present invention.

Further, another example of the partitioning member, as shown in FIG. 12, is a partitioning member 40 with a rhombic cross sectional shape in the direction of the thickness of the container, where a hollow part and rhombic lid 42 for sealing the bottom side of the hollow part are formed and a thin-wall part 44 and thick-wall part are formed in the connecting part between the lid 42 and the partitioning member body 43. As shown in FIG. 13, another example of the partitioning member is a partitioning member 40 with an elongated ellipse shape in the direction of the thickness of the container.

Figure 14:
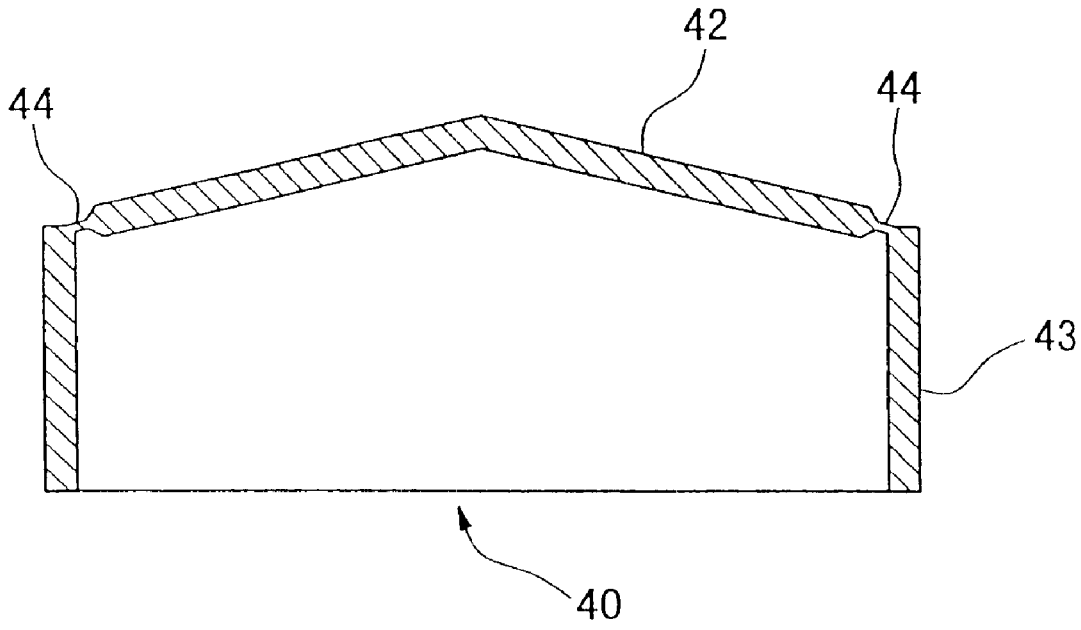
FIG. 14 is a cross sectional view of another example of the partitioning member in the medical container with multiple chambers according to the present invention.
Figure 15:
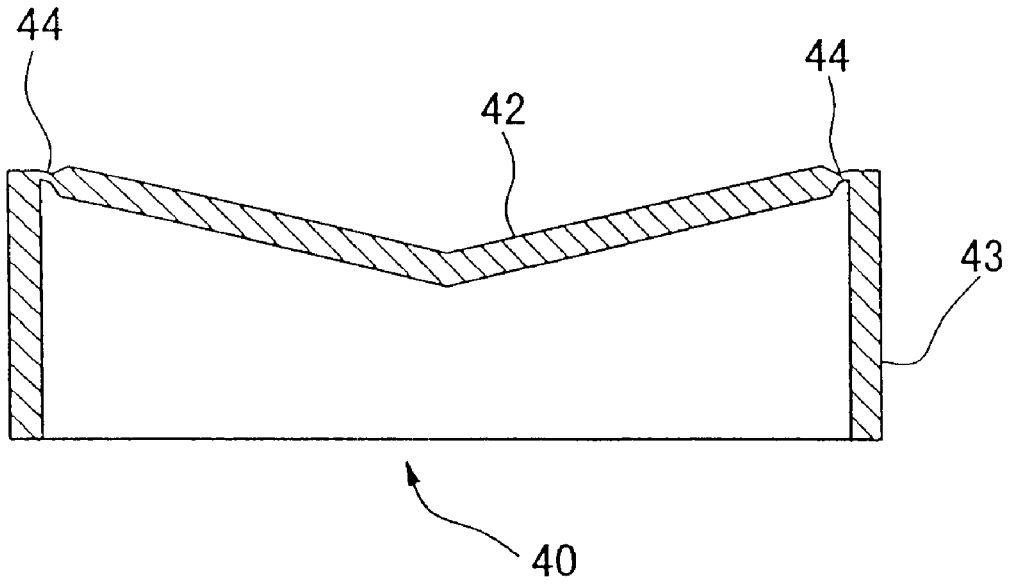
FIG. 15 is a cross sectional view of another example of the partitioning member in the medical container with multiple chambers according to the present invention.

In the above specific example, the lid 42 are planar, but the shape of the lid is not limited to any specific shape, and can be convex or concave and curved shapes, or a protruded shape as shown in FIG. 14, or an indented shape as shown in FIG. 15, are possible.

The production method of the medical container 1 with multiple chambers is described below.

A partitioning member 30 having formed therein a hollow part 31 and a lid 32 for sealing one end of the hollow part 31 is molded and a support 36 for holding the shape of the hollow part 31 is inserted through the opening of the partitioning member 30 into the hollow part 31.

Two sheets of film formed by T-die molding, lamination molding or the like are superposed while interposing a hollow plug 14 therebetween at one side, and the peripheral edges of the films are heat-sealed but the side opposing the side having the hollow plug 14 is left open. Thus, a bag-like first container 10 is prepared.

A partitioning member 30 is inserted into the opening end of the first container 10 so that the opening side of the partitioning member 30 extends to the outer side of the first container 10, and the first container 10 and the partitioning member 30 are welded by heat-sealing.

Separately, two sheets of stacked layer films each having a barrier layer as the outermost layer, formed by multi-layer inflation molding, multi-layer T-die molding, lamination molding or the like, are superposed and the peripheral edges of the stacked layer films are heat-sealed while leaving one side open. Thus, a bag-like second container 20 is prepared. The partitioning member 30 is inserted into the opening end of the second container 20 so that the opening side of the partitioning member 30 extends to the inner side of the second container 20, and the second container 20 is welded at the heat-seal part 16 as a portion where the first container 10 and the partitioning member 30 are welded. At this time, it may also be possible not to superpose the heat-seal part 25 of the second container 20 on the heat-seal part 16 but directly weld the second container 20 and the partitioning member 30.

The space between the chamber 21 in the second container 20 and the partitioning member 30 is heat-sealed in the width direction of the second container to form a weak seal part 26.

A liquid medicament 12 is filled into the chamber 11 through the hollow plug 14 at the lower end of the first container 10 and the hollow plug 14 is sealed by a rubber cap 15.

After the filling of the liquid medicament 12, the container is subjected to a sterilization treatment such as retort sterilization (high-pressure steam sterilization).

In a sterile room, the upper end of the second container 20 is cut and opened and a powder medicament 22 is filled into the chamber 21 of the second container 20. After the completion of the filling, the upper end of the second container is sealed by heat-sealing and in this heat-seal part, a hole 24 for hanging is punched. In this way, a medical container 1 with multiple chambers is produced.

According to this production method, a support 36 is inserted into the hollow part 31 of the partitioning member 30, so that the first container 10 and the second container 20 can be welded to the partitioning member 30 without causing any gaps, as a result, in the thus produced medical container 1 with multiple chambers, respective medicaments 12 and 22 housed in the chambers 11 and 21 can be separated without fail until the infusion.

Embodiment 2

Figure 16:
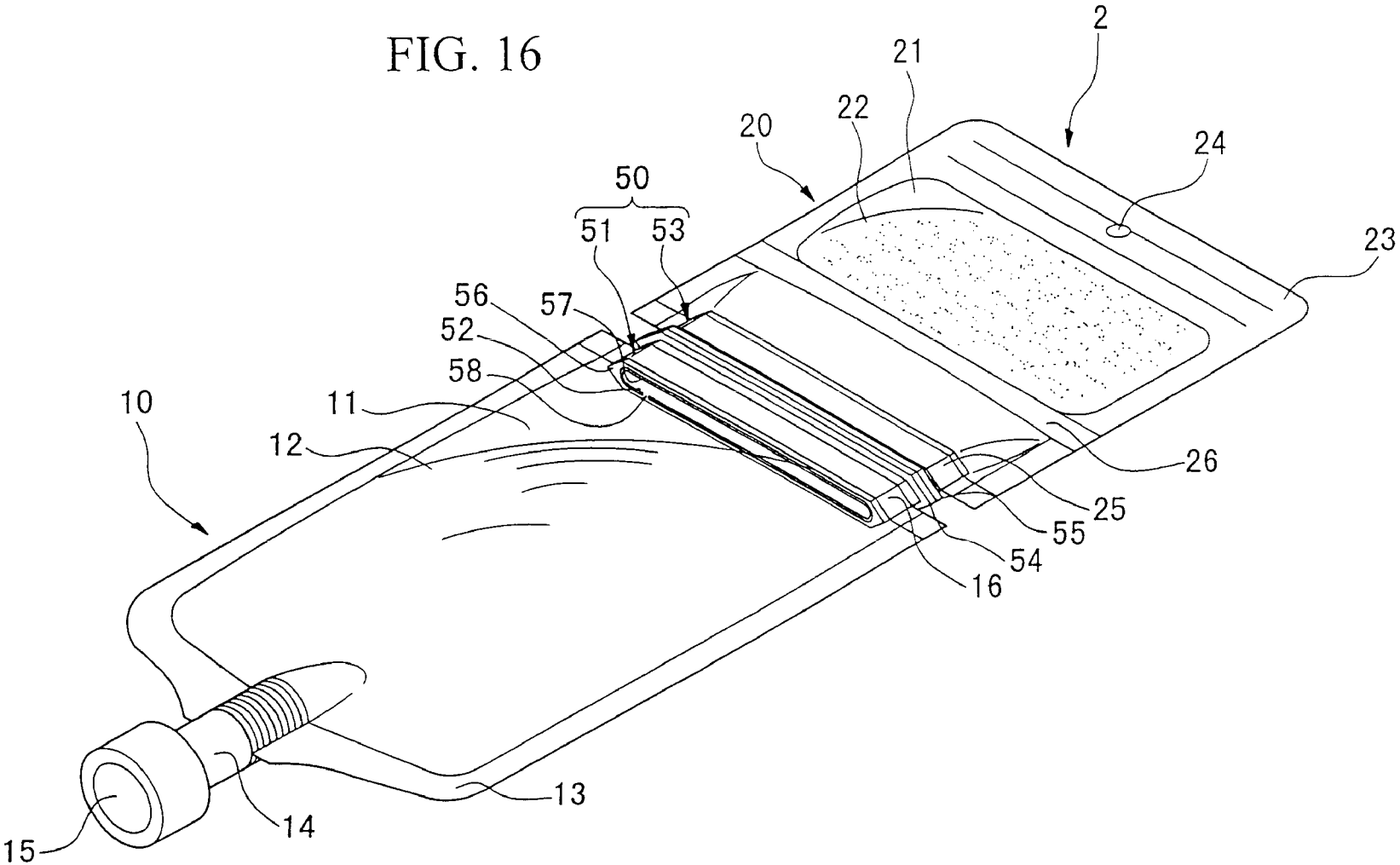
FIG. 16 is a perspective view showing another example of the medical container with multiple chambers according to the present invention.

FIG. 16 is a perspective view showing another embodiment of the medical container with multiple chambers according to the present invention. The same numerical references as in Embodiment 1 are used for the same parts.

The medical container 2 with multiple chambers is roughly constructed by comprising a first container 10 having formed in the inside thereof a chamber 11 for housing a liquid medicament 12, a second container 20 having formed in the inside thereof a chamber 21 for housing a powder medicament 22, and a partitioning member 50 for partitioning the first container 10 and the second container 20.

The partitioning member 50 comprises a sealing member 51 having formed therein a hollow part (not shown) and a lid 52 for sealing the lower end of the hollow part, and a hollow communicating member 53, where the flange 54 on the upper surface of the sealing member 51 and the flange 55 on the bottom surface of the communicating member 53 are welded and integrated. The sealing member 51 is provided at the upper end of the first container 10, and the sealing member 51 and the first container 10 are welded to each other in the heat-seal part 16. The communicating member 53 is provided at the lower end of the second container 20, and the communicating ember 53 and the second container 20 are welded to each other in the heat-seal part 25.

The partitioning member 50 is a hollow body elongated in the width direction of the container and narrow in the thickness direction of the container and shaped like the prow of a boat at each width direction end part, similarly to the partitioning member 30 in Embodiment 1.

In the connection part between the lid 52 and the sealing member body 56 of the sealing member 51, a thin-wall part 57 and a thick-wall part 58 are formed.

On the surface in the hollow part side of the lid 52, a plurality of ribs (not shown) running across the lid 52 are provided and on the lateral surfaces of the lid 52, inclined parts (not shown) inclining from the lateral side to the inner side in the direction toward the hollow part side are formed.

The thin-wall part 57 formed in the connection part between the lid 52 and the sealing member body 56 is a part which can be ruptured by a deformation operation applied from the exterior to the partitioning member 50. The thick-wall part 58 is not ruptured by a deformation operation from the exterior and continues to connect the lid 52 and the partitioning member body 56.

The ribs are provided to increase the strength of the lid 52 in the cross direction, increase the difference between the stress applied to the lid 52 and the stress applied to the partitioning member body 56 result from the externally applied forces of the deformation operation, and thereby accelerate the swinging open of the lid 52. The ribs can also prevent the lid 52 from swinging closed when mixing the medicament 12 and the medicament 22.

The inclined parts formed on the lateral surfaces of the lid 52 prevent the lid 52 from swinging open toward the hollow part side during the deformation operation applied to the partitioning member 50.

Similarly to the partitioning member 30 in Embodiment 1, when the partitioning member 50 is bent in a V-shape, different stresses are generated on the lid 52 and on the partitioning member body 56 resulting from the external forces and this difference in the stresses causes rupturing of the thin-wall part 57 formed in the connecting part between the lid 52 and the partitioning member body 56, whereby the lid 52 can swing open toward the outer side of the partitioning member 50. In this way, the first container 10 and the second container 20 are allowed to communicate and thereby the medicament 12 and the medicament 22 can be mixed. At this time, the lid 52 is connected to the partitioning member body 56 by the thick-wall part 58 and does not come off.

The production method of the medical container 2 with multiple chambers is described below.

A sealing member 51 having formed therein a hollow part and a lid 52 for sealing one end of the hollow part is molded and a support 36 for holding the shape of the hollow part is inserted into the hollow part from the opening of the sealing member 51.

Two sheets of film formed by T-die molding, lamination molding or the like are superposed while interposing a hollow plug 14 therebetween at one side, and the peripheral edges of the films are heat sealed but the side opposing the side having provided thereon the hollow plug 14 is left open. Thus, a bag-like first container 10 is prepared.

The sealing member 51 is inserted into the opening end of the first container 10 so that the opening side of the sealing member 51 faces the outside of the first container 10, and the first container 10 and the sealing member 51 are welded by heat-sealing.

After the first container 10 and the sealing member 51 are welded, the support 36 is removed from the hollow part of the sealing member 51.

A liquid medicament 12 is filled into the chamber 11 through the hollow plug 14 of the first container 10 and then, the hollow plug 14 is sealed by a rubber cap 15.

After the liquid medicament 12 is filled, the container is subjected to a sterilization treatment such as retort sterilization (high-temperature steam sterilization).

Separately, a communicating member 53 having formed therein a hollow part is molded and a support 36 for holding the shape of the hollow part is inserted into the opening on the bottom surface of this communicating member 53 and fixed.

Two sheets of stacked layer films having a barrier layer as the outermost layer, formed by multi-layer molding, multi-layer T-die molding, lamination molding or the like, are superposed and the peripheral edges of the stacked films are heat-sealed while leaving one side open. Thus, a bag-like second container 20 is prepared.

The communicating member 53 is inserted into the opening end of the second container 20 to allow the hollow part of the communicating member 53 to communicate between the interior and the exterior of the chamber 21 of the second container 20, and the second container 20 and the communicating member 53 are welded by heat-sealing.

After the second container 20 and the communicating member 53 are welded, the support 36 is removed from the hollow part of the communicating member 53.

The space between the chamber 21 in the second container 20 and the communicating member 53 is heat-sealed in the width direction of the second container to form a weak seal part 26.

Then, the second container 20 is subjected to a sterilization treatment by an electron beam or the like.

In a sterile room, the end part of the second container 20 opposing the end part welded to the communicating member 53 is cut and opened and a powder medicament 22 is filled into the chamber 21 of the second container 20. The opening end of the second container 20 having filled therein the medicament 22 is sealed by heat-sealing, and a hole 24 for hanging is punched in this heat-seal part.

In a sterile room, the flange 54 on the end face of the sealing member 51 provided at the end part of the first container 10 and the flange 55 on the end f ace of the communicating member 53 provided at the end part of the second container 20 are welded and integrated by a method such as butt welding, hot plate welding, impulse welding or high frequency welding. Among these, high frequency welding is preferred in view of high-speed productivity. In this way, the medical container 2 with multiple chambers is produced.

According to this production method of the medical container 2 with multiple chambers, the first container 10 and the second container 20 can be prepared in separate places and medicaments can be filled into respective containers in separate places. Furthermore, the support does not remain in the hollow part of the partitioning member 50 of the completed medical container 2 with multiple chambers.

While the invention has been described in detail and with reference to specific embodiments thereof, it will be apparent to one skilled in the art that various changes and modifications can be made therein without departing from the spirit and scope thereof.

What is claimed is:

1. A medical container (1, 2) with multiple chambers, obtained by integrating a plurality of containers (10, 20) each having a chamber (11, 21) for housing a medicament (12, 22), wherein:

said medical container (1, 2) has a partitioning member (30, 40) for partitioning said plurality of containers (10, 20);

a heat-seal part (26) is provided between said partitioning member (30, 40) and one end of at least one of said chambers (21);

said partitioning member (30, 40) further comprising: a hollow part (31) defined by a partitioning member body (33, 43) for allowing communication between said containers (10, 20);

a lid (32, 42) removably sealing at least one end of said hollow part (31); and a connection part connecting said lid (32, 42) and said partitioning member body (33, 43), said connection part is formed by a thin-wall part (34, 44) which is able to be ruptured by a difference in the stress between the lid (32, 42) and the partitioning member body (33, 43) resulting from external forces.

2. The medical container (1, 2) with multiple chambers as claimed in claim 1, wherein:

at least one of said plurality of containers (20) is a container having a chamber (21) for housing a powder medicament (22);

another container (10) is a container having a chamber (11) for housing a liquid medicament (12); and wherein the heat-seal part (26) can be peeled open by the inflow pressure of the liquid medicament (12).

3. The medical container (1) with multiple chambers as claimed in claim 1, wherein said partitioning member (30) is elongated and including end parts in a width direction of the container (1) and narrow in a thickness direction of the container (1) and each end part (30*a*) in the width direction of the container is wedge shaped.

4. The medical container (1) with multiple chambers as claimed in claim 2, wherein said partitioning member (30) is elongated and including end parts in a width direction of the container (1) and narrow in a thickness direction of the container (1) and each end part (30*a*) in the width direction of the container is wedge shaped.

5. The medical container (1) with multiple chambers as claimed in claim 3, wherein said lid (32) has a ribbon shape and ribs (37) running in a cross direction of the lid (32) are provided on the lid (32) surface facing the hollow part (31) of said partitioning member.

6. The medical container (1) with multiple chambers as claimed in claim 4, wherein said lid (32) has a ribbon shape and ribs (37) running in a cross direction of the lid (32) are provided on the lid (32) surface facing the hollow part (31) of said partitioning member.

7. The medical container (1) with multiple chambers as claimed in claim 3, wherein an inclined surface (38) is formed on each lateral surface of said lid (32) to incline towards the hollow part (31) when going from the lateral side to the inner side.

8. The medical container (1) with multiple chambers as claimed in claim 4, wherein an inclined surface (38) is formed on each lateral surface of said lid (32) to incline towards the hollow part (31) when going from the lateral side to the inner side.

9. The medical container (1) with multiple chambers of claim 1, wherein a cross section, in a thickness direction of the container (1), of the partitioning member (40) is rhombic shaped.

10. The medical container (1) with multiple chambers of claim 2, wherein a cross section, in a thickness direction of the container (1), of the partitioning member (40) is rhombic shaped.

11. The medical container (1) with multiple chambers of claim 1, wherein a cross section, in a thickness direction of the container (1), of the partitioning member (40) is shaped like an elongated ellipse.

12. The medical container (1) with multiple chambers of claim 2, wherein a cross section, in a thickness direction of the container (1), of the partitioning member (40) is shaped like an elongated ellipse.

13. The medical container (1) with multiple chambers of claim 1, wherein a cross section, in a thickness direction of the container (1), of the partitioning member (40) is circular.

14. The medical container (1) with multiple chambers of claim 2, wherein a cross section, in a thickness direction of the container (1), of the partitioning member (40) is circular.

15. A medical container (1,2) with multiple chambers as claimed in claim 1, wherein:

in the connection part between the lid (32, 42) and the partitioning member body (33, 43), a thick-wall part (35, 45) is formed; and said thick-wall part (35, 45) is formed not to be able to cause rupturing by a deformation operation from an exterior force and continues to connect the lid (32, 42) and the partitioning member body (33, 43).

16. A medical container (1, 2) with multiple chambers as claimed in claim 1, wherein:

the lid (32, 42) is allowed to swing open toward the outer side of said partitioning member (30, 40) when a deformation is applied to said partitioning member (30, 40).

17. A medical container (1, 2) with multiple chambers as claimed in claim 2, wherein the heat seal part (26) is provided between said partitioning member (30, 40) and the chamber for housing a powder medicament (22).

* * * * *